US006397523B1

(12) United States Patent
Fukumoto et al.

(10) Patent No.: US 6,397,523 B1
(45) Date of Patent: Jun. 4, 2002

(54) DRIVE DEVICE FOR A VEHICLE SLIDE DOOR

(75) Inventors: Ryoichi Fukumoto, Nagoya; Katsuhisa Yamada, Toyota; Masao Ohhashi, Kariya; Shintaro Suzuki, Kasugai, all of (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/459,897

(22) Filed: Dec. 14, 1999

(30) Foreign Application Priority Data

Dec. 14, 1998 (JP) ..... 10-355197

(51) Int. Cl.[7] ..... E05F 11/00
(52) U.S. Cl. ..... 49/360; 192/55.6
(58) Field of Search ..... 49/348, 349, 350, 49/351, 352, 360, 361, 337; 192/55.6, 209

(56) References Cited

U.S. PATENT DOCUMENTS

| | | | | |
|---|---|---|---|---|
| 4,121,382 A | * | 10/1978 | Dietrich et al. | 49/334 |
| 4,247,001 A | | 1/1981 | Wiegner | |
| 4,640,050 A | * | 2/1987 | Yamagishi et al. | 49/280 |
| 5,046,283 A | * | 9/1991 | Compeau et al. | 49/138 |
| 5,056,633 A | * | 10/1991 | Noel | 192/35 |
| 5,326,473 A | | 7/1994 | Lacombes | |
| 5,336,165 A | | 8/1994 | Twardowski | |
| D358,291 S | | 5/1995 | Ushikubo | |
| 5,487,827 A | | 1/1996 | Peterson et al. | |
| 5,547,645 A | | 8/1996 | Ego et al. | |
| D374,481 S | | 10/1996 | McCallister et al. | |
| D376,424 S | | 12/1996 | Macauley | |
| 5,591,344 A | | 1/1997 | Kenley et al. | |
| 5,658,456 A | | 8/1997 | Kenley et al. | |
| 5,692,410 A | * | 12/1997 | Fenelon | 74/411 |
| D395,517 S | | 6/1998 | Treu et al. | |
| 5,778,843 A | * | 7/1998 | Inoue et al. | 123/142.5 |
| 5,788,099 A | | 8/1998 | Treu et al. | |
| D403,079 S | | 12/1998 | Pawlak | |
| 5,875,588 A | * | 3/1999 | Torii et al. | 49/349 |
| 5,943,913 A | * | 8/1999 | Fenelon | 74/411 |
| 5,956,998 A | * | 9/1999 | Fenelon | 74/89.17 |
| 5,982,131 A | * | 11/1999 | Aino | 318/646 |
| 6,003,193 A | * | 12/1999 | Rivin et al. | 15/250.3 |
| 6,027,032 A | * | 2/2000 | Aoki et al. | 237/12.3 |
| 6,108,976 A | * | 8/2000 | Kato et al. | 49/360 |
| 6,183,040 B1 | * | 2/2001 | Imaizumi et al. | 296/155 |
| 6,198,242 B1 | * | 3/2001 | Yokomori et al. | 318/445 |

FOREIGN PATENT DOCUMENTS

| | | |
|---|---|---|
| JP | 9-48244 | 2/1997 |

* cited by examiner

*Primary Examiner*—Curtis A. Cohen
(74) *Attorney, Agent, or Firm*—Burns, Doane, Swecker & Mathis, LLP

(57) ABSTRACT

A drive device for a vehicle slide door apparatus includes a first rotation disc assembly mounted on a shaft to be rotated together with the shaft and a second rotation disc assembly mounted on the shaft to be rotatable relative to the shaft. The second rotation disc assembly is coupled to the first rotation disc assembly in detachable manner, and the second rotation disc assembly is operatively associated with an electric driving source. An output gear is mounted on the shaft so as to be rotated together with the shaft.

17 Claims, 9 Drawing Sheets

DRIVE DEVICE FOR A VEHICLE SLIDE DOOR

This application is based on and claims priority under 35 U.S.C. § 119 with respect to Japanese Application No. 10(1998)-355197 filed on Dec. 14, 1998, the entire content of which is incorporated herein by reference.

FIELD OF THE INVENTION

The present invention generally relates to a vehicle door. More particularly, the present invention pertains to a slide door apparatus for vehicles.

BACKGROUND OF THE INVENTION

A drive device utilizing an electric motor for slidably moving the slide door of a van type vehicle is disclosed in, for example, Japanese Patent Laid-Open Publication No. Hei. 9-48244, published without examination in 1997. In this drive device, the motor is coupled to a shaft by way of a clutch mechanism and the driving force produced by the motor is transmitted to the shaft which is operatively coupled to the slide door. Thus, the slide door is moved in one direction when the transmitted force rotates the shaft in one direction and is moved in the other direction when the transmitted force rotates the shaft in the opposite direction.

However, in this drive device, the shaft is a two-piece structure, thus requiring a connecting device between the two pieces. This construction also has a tendency to make the neighboring structure more complex.

Accordingly, a need exists for a simplified sliding door construction.

SUMMARY OF THE INVENTION

In light of the foregoing, one aspect of the present invention includes a drive device for a vehicle slide door apparatus that includes a shaft for transmitting a force derived from an electric driving source to the slide door for effecting sliding movement of the slide door, an output gear mounted on the shaft to rotate together with the shaft, a first rotation disc assembly mounted on the shaft for rotating together with the shaft, and a second rotation disc assembly mounted on the shaft for rotation relative to the shaft and operatively connected to the electric driving source, with the second rotation disc assembly being adapted to be coupled to the first rotation disc assembly in a detachable manner.

According to another aspect of the invention, a drive device for a vehicle slide door includes an electric drive source for producing an output force, a rotatable shaft for transmitting a force derived from the electric driving source to the slide door for effecting sliding movement of the slide door, an output gear mounted on the shaft for rotation together with the shaft, a cable connectable to the slide door and engaged by the output gear, and a clutch mechanism mounted on the shaft for transferring the force derived from the electric driving source to the shaft to rotate the shaft. The clutch mechanism includes a first rotation disc assembly mounted on the shaft for rotating together with the shaft and a second rotation disc assembly mounted on the shaft for rotation relative to the shaft. The second rotation disc assembly is operatively connected to the electric driving source, and the clutch mechanism is operable to cause engagement between the first rotation disc assembly and the second rotation disc assembly to thereby operatively connect the electric driving source to the shaft to rotate the shaft and thereby cause rotation of the output gear and movement of the cable for effecting sliding movement of the slide door.

In accordance with another aspect of the invention, a vehicle slide door apparatus is defined by a slide door mounted on the lateral side of the vehicle body for movement in the lengthwise direction of the vehicle body between an open position and a closed position, a connecting member connected to the slide door to move with the slide door, an electric drive source, a rotatable shaft journalled in a casing, and an output gear mounted on the shaft for rotation together with the shaft, with the connecting member being engaged by the output gear so that the output gear and the connecting member move together. A clutch mechanism is mounted on the shaft for transferring the force derived from the electric driving source to the shaft to rotate the shaft. The clutch mechanism includes a first rotation disc assembly mounted on the shaft for rotating together with the shaft and a second rotation disc assembly mounted on the shaft for rotation relative to the shaft. The second rotation disc assembly is operatively connected to the electric driving source, and the clutch mechanism is operable to cause engagement between the first rotation disc assembly and the second rotation disc assembly to thereby operatively connect the electric driving source to the shaft to rotate the shaft and cause rotation of the output gear and movement of the connecting member for effecting sliding movement of the slide door.

BRIEF DESCRIPTION OF THE DRAWING FIGURES

The foregoing and additional features of the present invention will become more apparent from the following detailed description considered with reference to the accompanying drawing figures in which like elements are designated by like reference numerals and wherein.

DETAILED DESCRIPTION OF THE INVENTION

Figure 1:
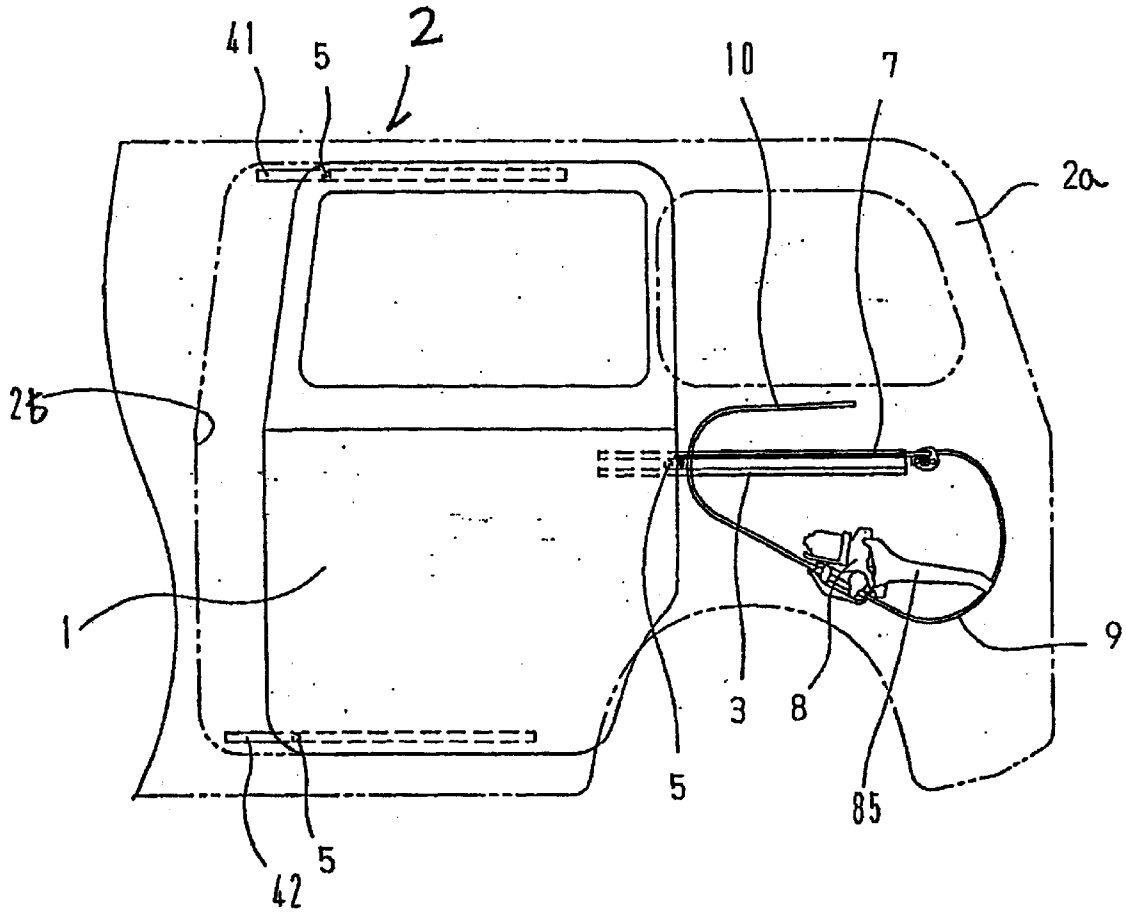
FIG. 1 is a side view of a vehicle body at which is located a slide door apparatus according to the present invention.
Figure 2:
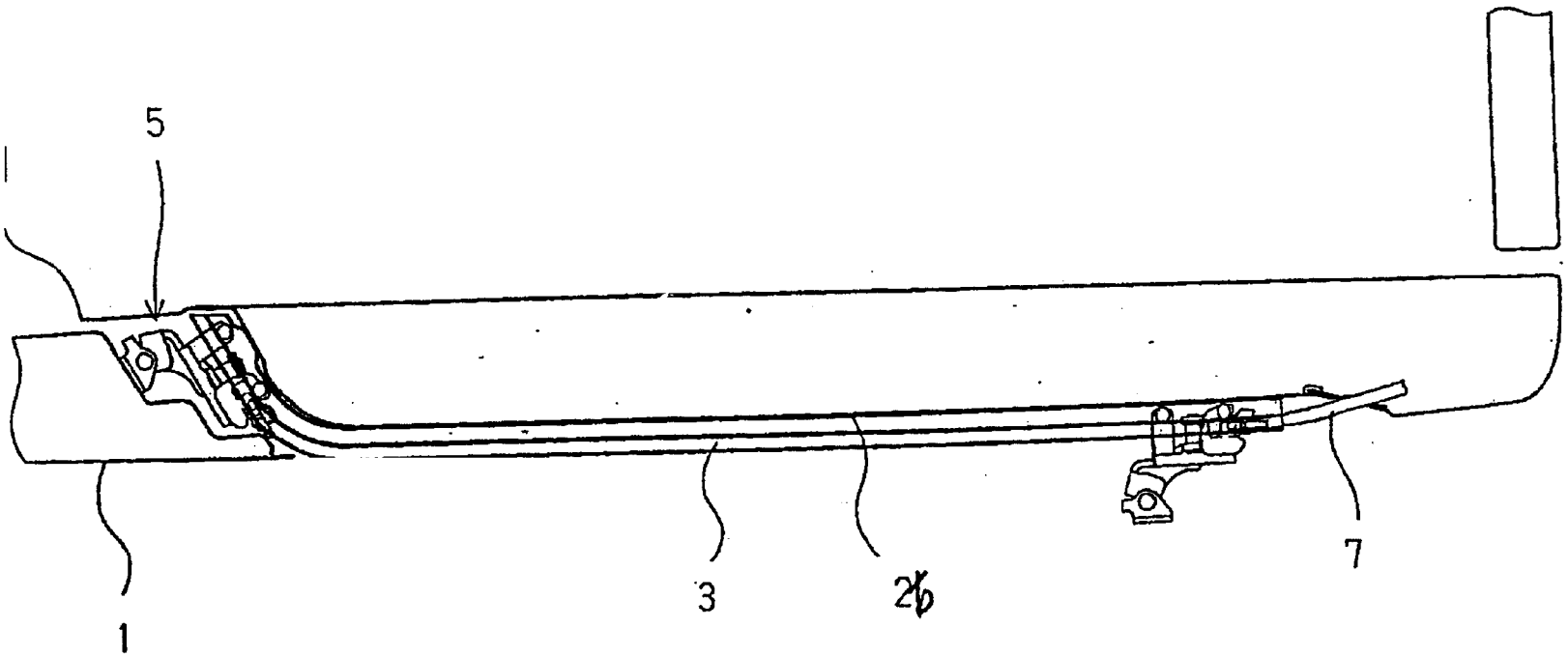
FIG. 2 is a horizontal cross-sectional view of the slide door apparatus shown in FIG. 1.

FIGS. 1 and 2 illustrate the rear portion of the vehicle body 2 of a van type vehicle. The lateral side 2*a* of the vehicle body 2 is provided with an opening area 2*b* possessing a substantially rectangular shape. The opening area 2*b* is adapted to be closed and opened by a slide door 1. The slide door 1 is supported by an upper guide rail 41, a lower guide rail 42 and a center guide rail 3 so as to be movable in the vehicle lengthwise direction corresponding to the right-and-left direction in FIG. 1.

The upper guide rail 41 is arranged along the upper periphery of the opening area 2*b* at a position closely adjacent the opening area 2*a* and is secured to the lateral side 20 of the vehicle body 2 by way of suitable connecting devices such as screws. The lower guide rail 42 is arranged along the lower periphery of the opening area 2*b* at a position closely adjacent the opening area 2*a* and is secured to the lateral side 2*a* of the vehicle body 2 by way of suitable connecting devices such as screws. The center guide rail 3 is positioned at the rear side of the opening area 2*b* and is secured to the lateral side 2*a* of the vehicle body 2 by way of suitable connecting devices such as screws.

The slide door 1 is provided with three guide roller units 5 which slidably engage the respective guide rails 3, 41, 42, thereby allowing the slide door 1 to slide along the guide rails 3, 41, 42. The guide rails 3, 41, 42 are arranged parallel to each other and extend in the vehicle lengthwise direction. For establishing a coplanar relationship between the outer surface of the slide door and the outer surface of the lateral side 2*a* of the vehicle body 2 when the opening area 2*b* is fully closed by the slide door 1, the front end of each of the guide rails 3, 41, 42 is bent toward the interior or inner space of the vehicle body 2. When the opening area 2*b* is fully opened, the slide door 1 is positioned at the rear side of the opening area 2*b* and is positioned in an overlapping or layered condition relative to the lateral side 2*a* of the vehicle body 2.

Figure 3:
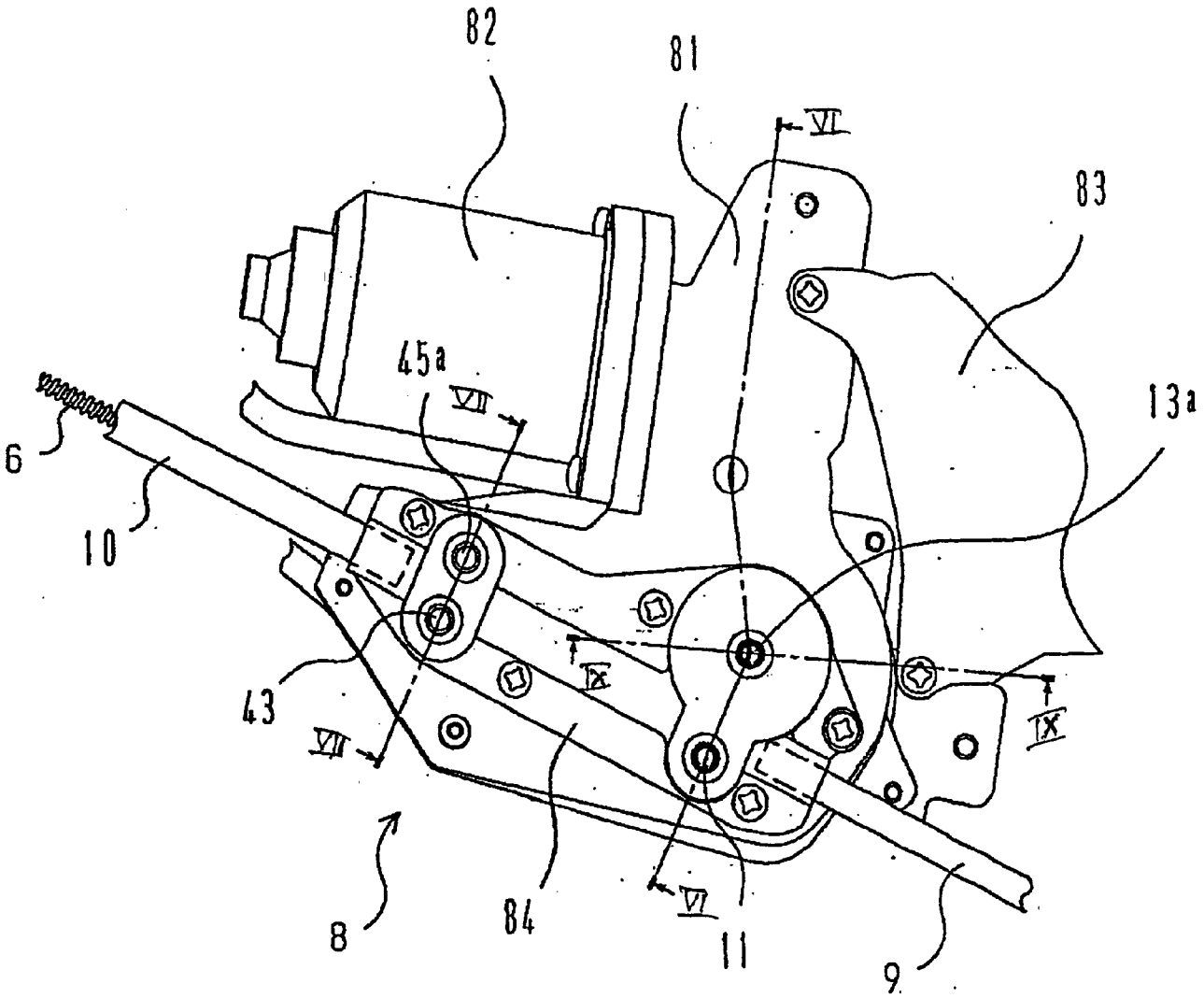
FIG. 3 is a front view of the driving device associated with the slide door apparatus shown in FIG. 1.

The roller unit 5 which slides along the center guide rail 3 is connected to one end of a geared cable 6, seen in FIG. 3, which passes through several guide pipes 7, 9, 10. The other end of the geared cable 6 forms a free end of the cable. The geared cable 6 is connected to a drive device 8, the details of which will be described below, at a position between the guide pipes 7, 9. The guide pipe 7 extends along the center guide rail 3 and is secured to the center guide rail 3. The guide pipe 9 is fixed to the inside of the vehicle body 2, with one end of the guide pipe 9 passing therethrough for being connected to the guide pipe 7 at the rear portion of the guide rail 3. The other end of the guide pipe 9 is connected to the drive device 8. The guide pipe 10 is fixed inside the vehicle body 2 and is connected to the drive device 8.

When the drive device 8 is turned on, the geared cable 6 is moved in one direction, which causes movement of the center positioned roller unit 5 along the center guide rail 3. As a result, the slide door 1 moves along the guide rails 3, 41, 42 , thereby opening the opening area 2*b* in the lateral side 2*a* of the vehicle body. When the drive device 8 is operated in the opposite direction, the geared cable 6 is moved in the opposite direction, and this causes movement of the center positioned roller unit 5 along the center guide rail 3 in the opposite direction. The slide door 1 is thus moved along the guide rails 3, 41, 42, thereby closing the opening area 2*b* in the lateral side 2*a* of the vehicle body.

Referring to FIGS. 3–7, the drive device 8 includes a casing 81 and an electric motor 82 functioning as an electrical driving source. The casing 81 is fixedly mounted on a bracket 83 which is secured to the lateral side 2*a* of the vehicle body 2. The motor 82 is fastened to the casing 81. The casing 81 includes a first housing part 81a and a second housing part 81*b* which are coupled or connected with each other by way of bolts 81*c*. An inner space D is defined within the housing that results from connection of the two housing parts 81*a*, 81*b*. The housing 81*a* of the casing 8 is connected with a cover 84 by a bolt 84*a*, thereby defining an accommodating space E between the housing 81*a* and the cover 84.

A shaft 11 is journalled in the casing 81. The shaft 11 passes through the housing 81*a*, the inner space D, and the accommodating space E. One end portion 11*a* of the shaft 11 is journalled in the cover 84 via a bush 84*b*, while the other end portion 11*b* of the shaft 11 is journalled in the housing 81*b* via a bush 81*d*. A portion 11*c* of the shaft 11 is also journalled in the housing 81*b* via a bush 81*e*. Between the end portions 11*a*, 11*c*, the shaft 11 is provided with a portion 11*e* in the form of a serration which is positioned in the accommodating space E. Between the portions 11*c*, 11*b*, the shaft 11 is provided with a supporting portion 11*f* and a serrated portion 11*g*.

An output gear 12 is mounted on the serrated portion 11*e* of the shaft 11 so that the output gear 12 and the serrated portion 11*e* of the shaft 11 are rotatable together. In the accommodating space E, a driven gear 13 is rotatably supported on the housing 81*a* and the cover 84 via a pin 13*a*, and is positioned in opposition to the output gear 12. The geared cable 6 which is accommodated in the accommodating space E is in meshing engagement with both the output gear 12 and the driven gear 13.

A rotor 14 formed of a magnetic material and constituting a first rotation disc assembly is mounted on the serrated portion 11*g* of the shaft 11 so that the rotor 14 rotates together with the serrated portion 11*g* of the shaft 11. The upper and lower surfaces of the rotor 14 are provided with respective annular grooves 14*b*, 14*c* which communicate with each other by a plurality of circumferentially arranged arc-shaped slots 14*a* having a common center point. An annular geared projection 14*d* is formed on the upper surface of the rotor 14 and is positioned outside the groove 14*c*.

Figure 5:
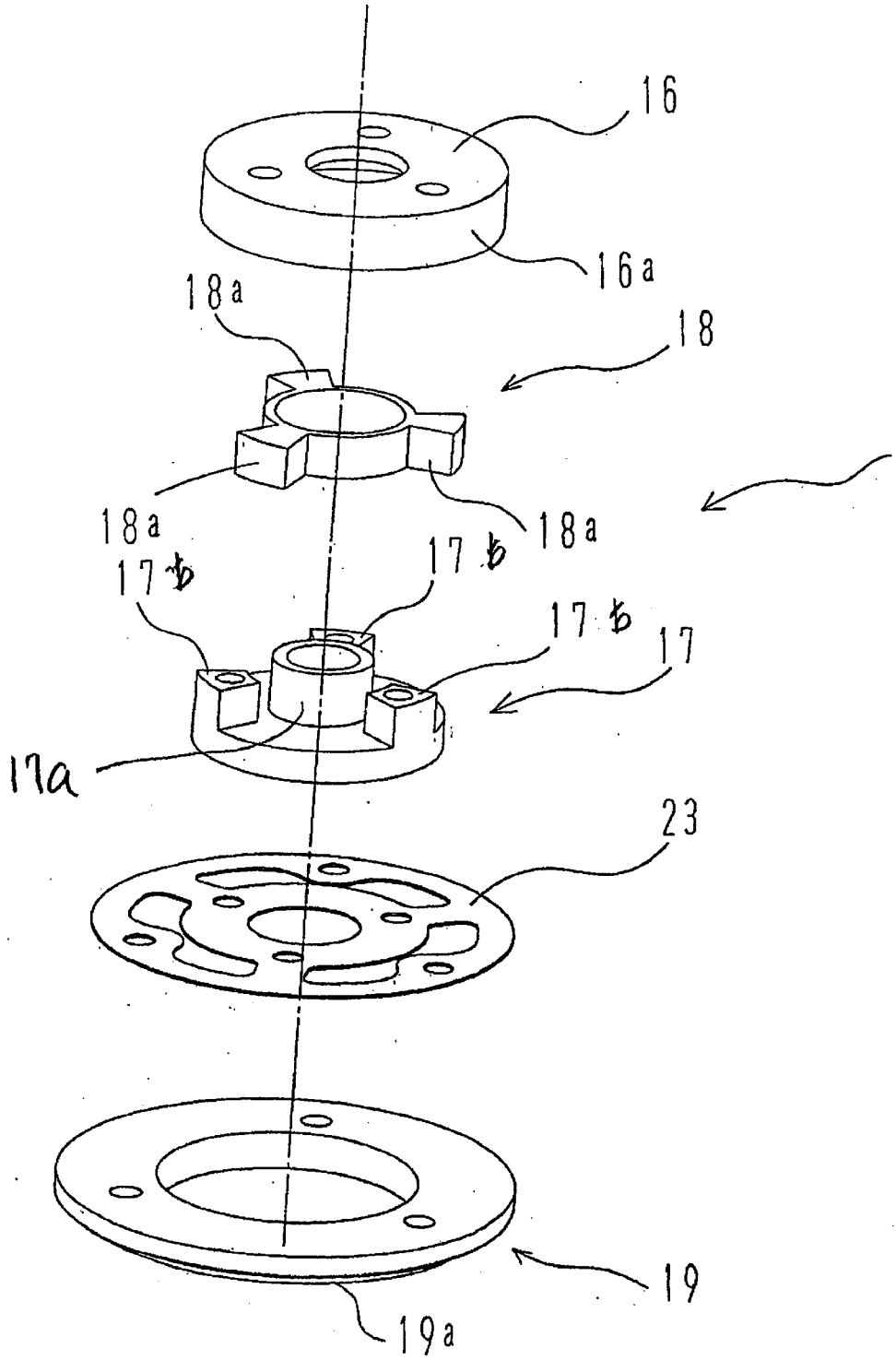
FIG. 5 is an exploded perspective view of the second disk assembly employed in the driving device shown in FIG. 3.
Figure 6:
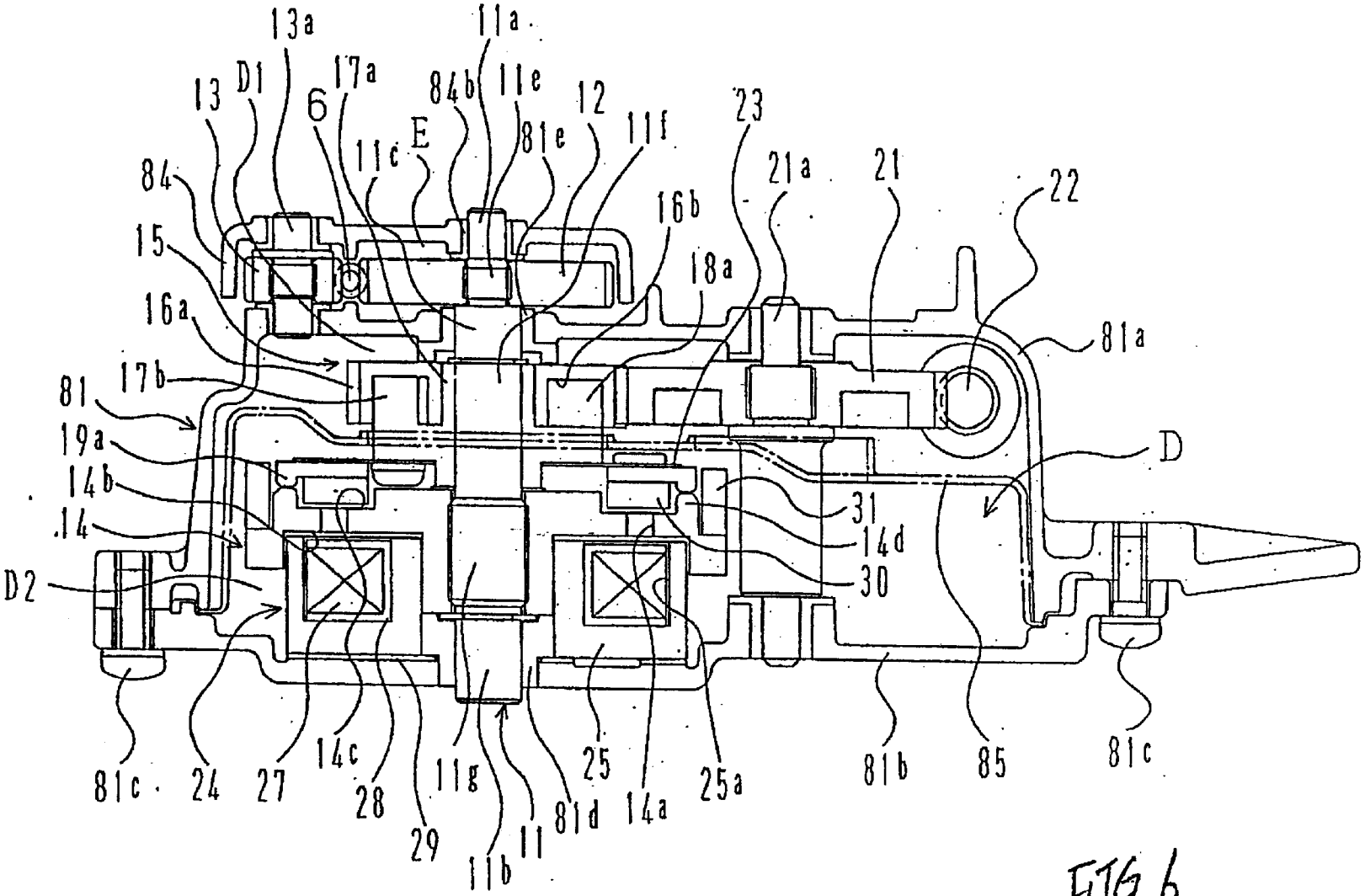
FIG. 6 is a cross-sectional view taken along the section line VI—VI in FIG. 3.
Figure 7:
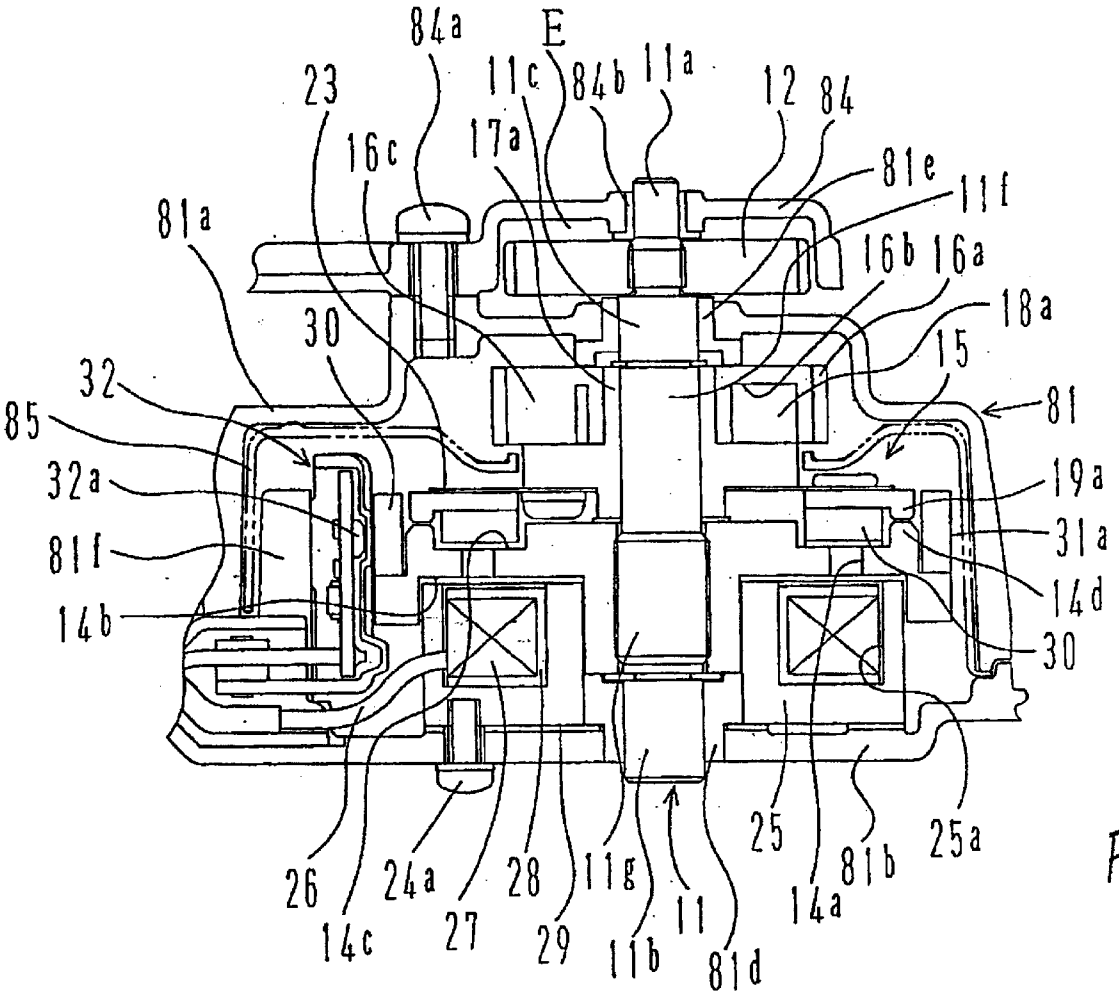
FIG. 7 is a cross-sectional view taken along the section line VII—VII in FIG. 3.

A disk assembly 15 constituting a second rotation disc assembly is mounted on the supporting portion 11*f* of the shaft 11 to rotate relative to the supporting portion 11*f*. As best shown in FIG. 5, the disk assembly 15 includes an input wheel 16, an output wheel 17, a movable plate 19, and an elastic member 18 formed of, for example, rubber. The output wheel 17 is rotatably mounted on the supporting portion 11*f* of the shaft 11.

The input wheel 16 is rotatably mounted on a boss portion 17*a* of the output wheel 17. The outer periphery of the input wheel 16 possesses a geared configuration 16*a* which is in indirect meshing engagement with a worm gear 22 via an idle gear 21. The idle gear 21 is positioned in the inner space D of the casing 81 and is rotatably supported on the two housing parts 81*a*, 81*b* via a pin 21*a*. The worm gear 22, which is in meshing engagement with the idle gear 21, is fixedly mounted on the output shaft of the motor 82 which extends into the inner space D of the casing 81. The idle gear 21 and the worm gear 22 constitute a speed reduction gear train 20.

The input wheel 16 is provided in its lower surface with an annular groove 16*b* into which a plurality of projections 16*c* extend. The output wheel 17 is provided with equi-pitched projections 17*b* each of which, when fitted in the annular groove 16*b* in the input wheel 16, is in opposition to two adjacent projections 16*c*, 16*c*. An elastic member 18 which is accommodated in the annular groove 16*b* of the input wheel 16 has equi-pitched damper portions 18*a* each of which is positioned between two adjacent projections 16*c*, 17*b*.

The movable plate 19 is in the form of a circular plate. The upper surface of the movable plate 19 is secured to a ring-shaped leaf spring 23 by way of screws which are riveted to the output wheel 17, thus allowing the movable plate 19 to rotate together with the output wheel 17. The movable plate 19 is capable of being deformed in its axial direction, which enables the movable plate 19 to move in the axial direction. The movable plate 19 is provided at its lower surface with a ring-shaped or annular geared portion 19*a*.

When the electric motor 82 is turned on, the resulting rotational torque is transmitted, by way of the speed-reduction gear train 20, to the input wheel 16. The resulting rotation of the input wheel 16 is transmitted from the projections 16*a* of the input wheel 16 to the projections 17*b* of the output wheel 17 via the damper portions 18*a* of the elastic member 18, thereby rotating the output wheel 17. At this time, the damper portions 18*a* of the elastic member 18 absorb shocks to some extent which inevitably occur between the input wheel 16 and the output wheel 17.

The rotation of the output wheel 17 is transmitted by way of the leaf spring 23 to the movable plate 19. This causes rotation of the movable plate 19, thereby rotating the rotor 14 which is in meshing engagement with the movable plate 19 by engagement of the geared portion 19*a* of the movable plate 19 with the geared projection 14*d* on the rotor 14.

A ring-shaped or annular electromagnetic coil winding device 24 is accommodated within the inner space D of the casing 81 so that the electromagnetic coil winding device 24 is positioned around the shaft 11. The coil winding device 24 includes a core 25 and a coil winding 27. The core 25 is formed of a magnetic material and has an upper open-faced annular groove 25*a*. The coil winding 27 is supplied with electric current from an external power supply by way of a pair of harnesses 26. The coil winding 27 is formed on a bobbin 28 in winding mode and is accommodated in the annular groove 25*a*. The electromagnetic coil winding device 24 is positioned in the annular groove 14*b* of the rotor 14 and is secured to the housing 81*b* of the casing 81 by a plurality of bolts 24*a*. An anti-vibration plate 29 made of a rubber or a resin material is held between the housing 81*b* and the coil winding device 24.

A ring-shaped or annular armature 30 which is formed of electromagnetic material is fixedly mounted on the lower surface of the movable plate 19. The armature 30 is positioned in the annular groove 14*c* of the rotor 14 and is located in opposition to the electromagnetic coil winding device 24 with the rotor 14 being located between the armature 30 and the electromagnetic coil winding device 24. Positioning the electromagnetic coil winding device 24 and the armature 30 in the respective annular grooves 14*b*, 14*c* of the rotor 14 reduces the axial extent or thickness of the driving device 8, thereby establishing a thinner driving device 8.

The movable plate 19 of the disk assembly 15, the rotor 14, and the electromagnetic coil winding device 24 together constitute a clutch mechanism CL.

When the coil winding 27 of the electromagnetic coil winding device 24 is energized, a magnetic closed loop is produced which circulates through the coil winding 27, the core 25, the rotor 14, and the armature 30. This generates an electromagnetic force attracting the armature 30 toward the rotor 14. Then, the movable plate 19 is brought into axial movement toward the rotor 14 in such a manner that the movable plate 19 is increasingly deformed, which causes a meshing engagement between the geared portion 19*a* of the movable plate 19 and the geared portion 14*a* of the rotor 14. Thus, the clutch mechanism CL assumes its ON-condition which allows the rotor 14 to rotate together with the disk assembly 15. At this time, the anti-shock plate 29 decreases the shock sound which is inevitably generated upon meshing engagement between the geared portion 19*a* of the movable plate 19 and the geared portion 14*a* of the rotor 14, thereby reducing the resonance sound at the lateral side 2*a* of the vehicle body 2. Thus, the sound which occurs during the operation of the driving device 8 becomes reduced to a significant extent.

On the other hand, when current application to the coil winding 27 of the electromagnetic coil winding device 27 is interrupted, the foregoing attraction force disappears or is no longer present. The restoration force of the leaf spring 23 thus causes the reverse axial movement of the movable plate 19, thereby releasing the geared portion 19*a* of the movable plate 19 from the geared portion 14*d* of the rotor 14. The clutch mechanism CL thus assumes the OFF-condition under which the disk assembly 15 is able to rotate relative to the rotor 14.

An annular magnet 31 is fixedly positioned in the annular groove 14*c* of the rotor 14. The magnet 31 is positioned outside the magnetite closed loop which circulates through the core 25, the rotor 14, and the armature 30. Thus, the magnet 31 is not affected even when the coil winding 27 is being applied with current. Plural sets of N-pole and S-pole combinations are magnetized alternately along the entire outer periphery 31*a* of the magnet 31 in such a manner that the N-poles and S-poles are arranged alternately.

A door sensor 32 is provided in the casing 81 and is positioned to oppose the magnet 31. The sensor 32 includes a pair of Hall elements 32*a*, 32*a* both of which are secured to a vertical wall 81*f* of the housing 81*b* by screws. While the magnet 31 is being rotated, the Hall elements 32*a*, 32*a* issue signals, respectively, which are of a phase difference of 90 degrees. This means that the sensor 32 serves for detecting the rotational condition of the rotor 14. Such signals are fed to a CPU and are used to calculate the sliding speed of the slide door 1, the sliding direction of the slide door 1, and the current position of the slide door 1.

A divider 85 is positioned in the casing 81 such that the outer periphery of the divider 85 is held between the housings 81*a*, 81*b*. The shaft 11 passes through the divider 85. The divider 85 divides the inner space D of the casing 81 into a first inner sub-space D1 and a second inner sub-space D2. The input wheel 16 of the disk assembly 15 and the speed reduction gear train 20 are accommodated in the first inner sub-space D1, while the output wheel 17 of the disk assembly 15, the movable plate 19, the rotor 14, the electromagnetic coil winding device 24, and the sensor 32 are accommodated in the second inner sub-space D2. Due to this arrangement, the rotor 14, the movable plate 19, and the sensor 32 are not liable to be infiltrated with grease between the idle gear 21 and the input wheel 16 and with metal powder generated by the meshing engagement.

The following is a description of the operation of the driving device 8 in conjunction with slide movement of the slide door 1. To slide the slide door 1, the clutch mechanism CL is first brought into the ON-condition under which the rotor 14 is rotatable together with the disk assembly 15 due to the fact that the geared portion 14*d* of the rotor 14 is in meshing engagement with the geared portion 19*a* of the movable plate 19 while the coil winding 27 of the coil winding device 24 is being energized. Under such a condition, if the electric motor 82 is turned on, the resulting rotation, after passing through the speed reduction gear train 20, rotates the disk assembly 15 and the rotor 14, which causes rotation of the shaft 11, thereby rotating the output gear 12. Thus, the geared cable 6 which is in meshing engagement with the output gear 12 is moved in one direction to open the slide door 1 or in the opposite direction to close the slide door 1. Establishing concurrent rotation of the rotor 14 and the disk assembly 15 causes an electrical operation of the slide door 1 under which the slide door 1 is moved by the electric motor 82. Immediately upon the slide door 1 being brought into its fully opened condition or closed condition, the current application to the coil winding 27 of the electromagnetic coil winding device 24 and the electric motor 82 is turned off.

When the clutch mechanism CL is in the OFF-condition, the rotor 14 is rotatable relative to the disk assembly 15 due to the fact that the geared portion 14*d* of the rotor 14 is out of meshing engagement with the geared portion 19*a* of the movable plate 19 and the coil winding 27 of the coil winding device 24 is not being energized. Under such a condition, manual operation of the slide door 1 is established. That is, if the slide door 1 is moved manually in one direction to open the slide door or is moved in the opposite direction to close the slide door, the resulting movement of the geared cable 6 rotates the shaft 11 due to the fact that the geared cable 6 is in meshing engagement with the output gear 12. The rotor 14 is thus rotated. At this time, the geared portion 14*d* of the rotor 14 is out of meshing engagement with the geared portion 19*a* of the movable plate 19 and so rotation of the rotor 14 is not transmitted to the disk assembly 15.

Figure 4:
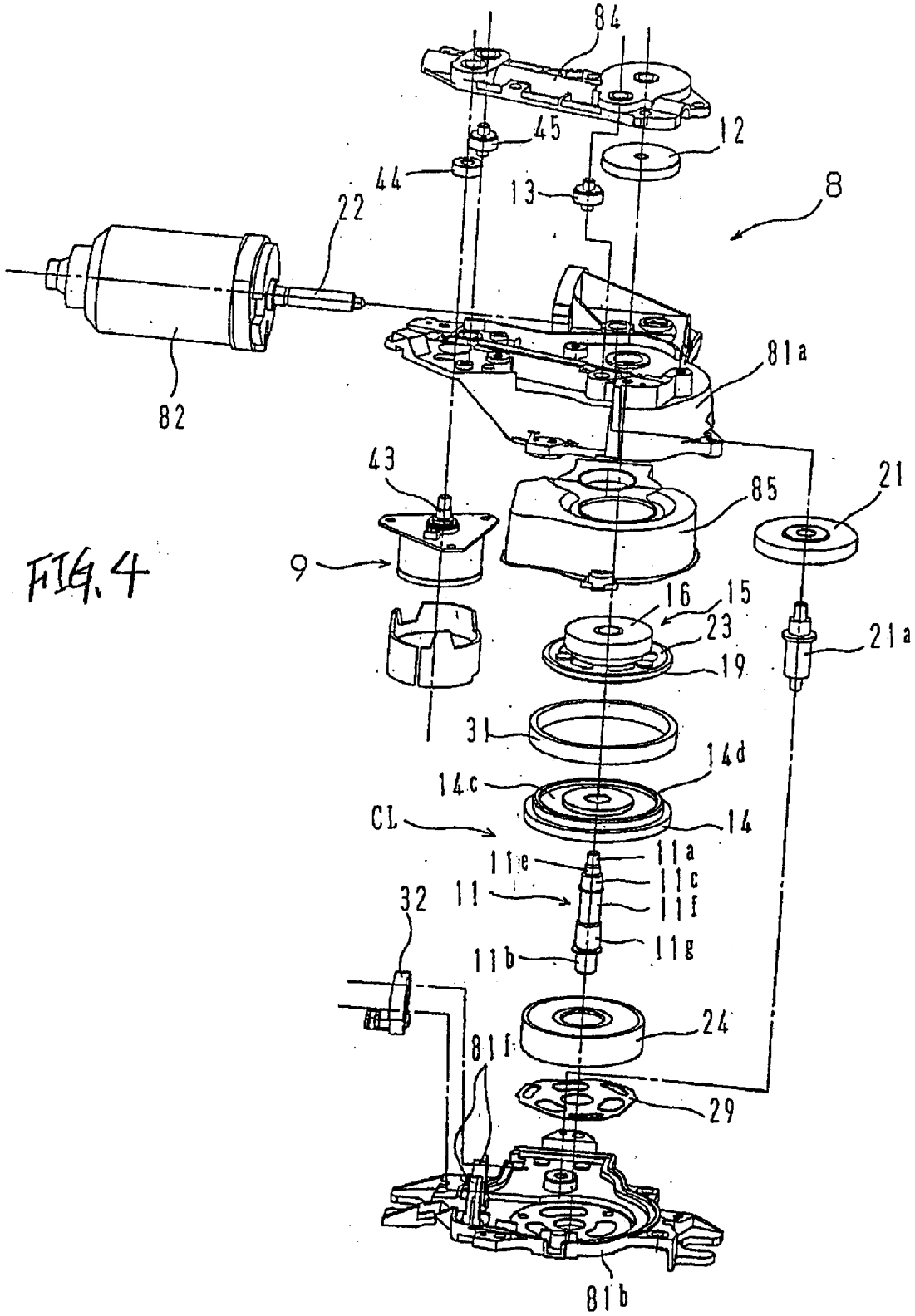
FIG. 4 is an exploded perspective view of the driving device shown in FIG. 3.

As can be understood from the illustration of FIG. 4, the clutch mechanism CL is provided with a brake device 99.

Figure 8:
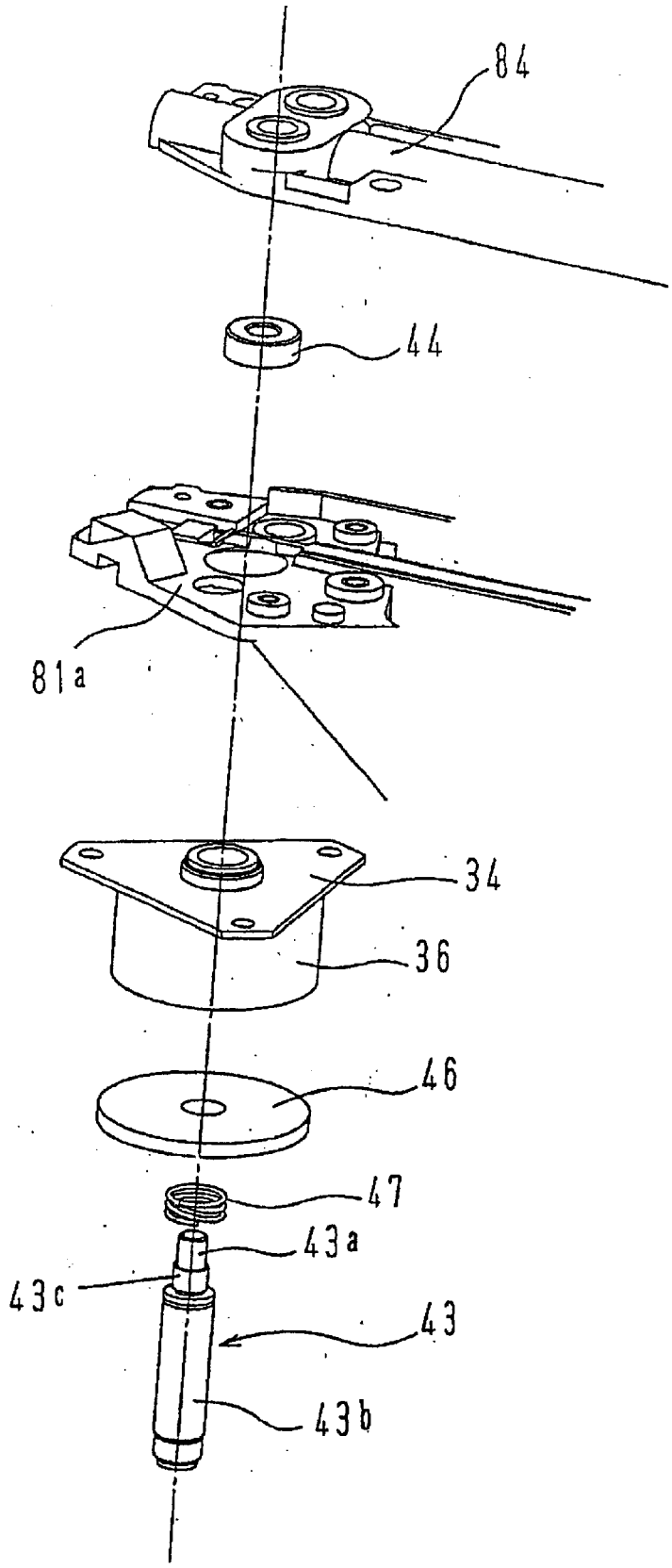
FIG. 8 is an exploded perspective view of the brake device used in conjunction with the driving device shown in FIG. 3.
Figure 9:
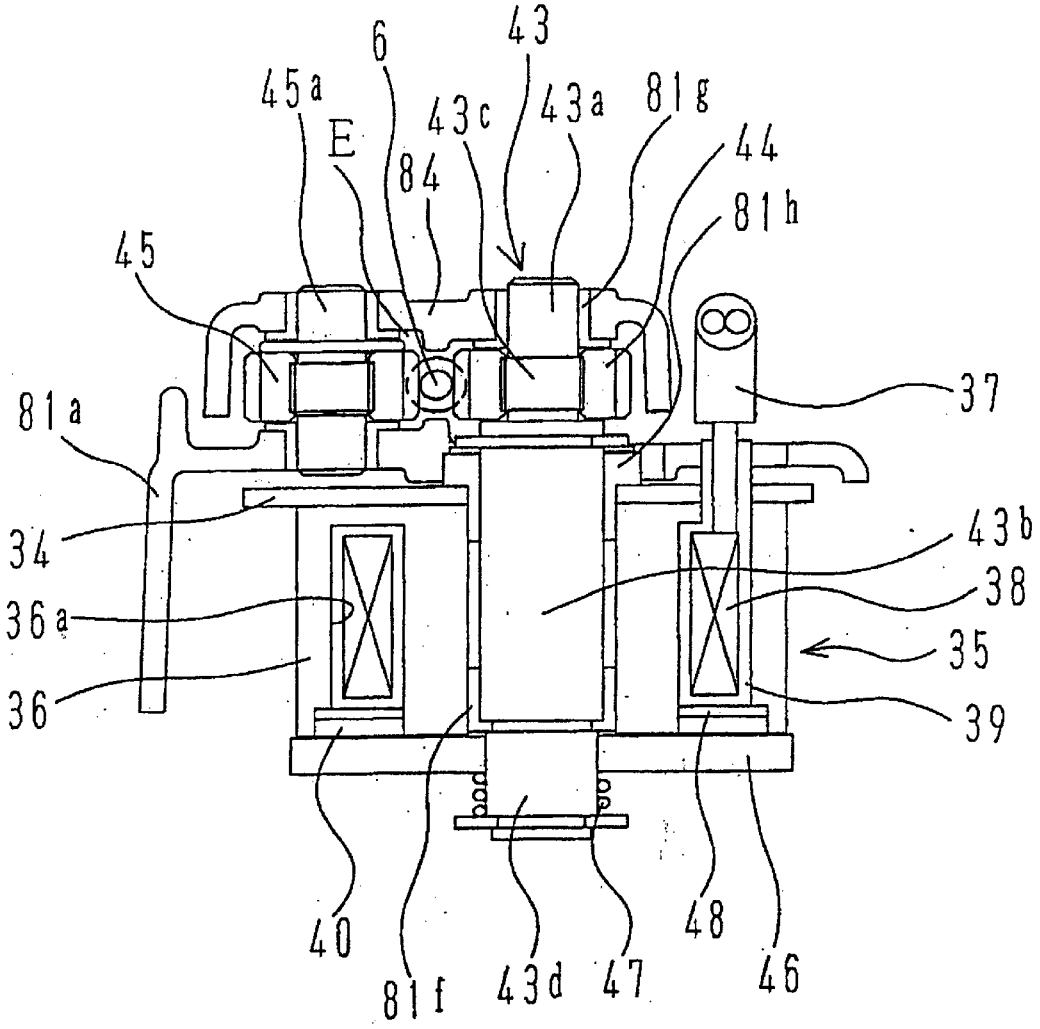
FIG. 9 is a cross-sectional view taken along the section line IX—IX in FIG. 3.

With reference to FIGS. 8 and 9, a bracket 34 is secured by bolts to the housing 81*a* of the casing 81. The bracket 34 is fixed with an electromagnetic coil winding device 35. The coil winding device 35 includes a core 36 and a coil winding 38. The core 36 is formed of a magnetic material and has a lower open-faced annular groove 36*a*. The coil winding 38 is applied with electric current from an external power supply by way of harness wires 37. The coil winding 38 is mounted on a bobbin 39 and is accommodated in the annular groove 36*a*. The opening of the annular groove 36*a* is closed by an annular metal plate 48 and a friction plate 40 in such a manner that the friction plate 40 projects slightly beyond the bottom of the core 36.

A shaft 43 is journalled in the electromagnetic coil winding device 35 via a pair of axially spaced bushes 81*g*, 81*f*. The shaft 43 is so positioned as to traverse the accommodating space E after passing through the bracket 34 and the housing 81*a*. One end side portion 43*a* of the shaft 43 is journalled in the cover 84 via a bush 81*g*, and an intermediate portion 43*b* of the shaft 43 around which the coil winding device 35 is positioned is journalled in both the bracket 34 and the housing 81*a* via a bush 81*h*. The shaft 43 is provided with a serration portion 43*c* between the end portion 43*a* and the intermediate portion 43*b*, and is located within the accommodating space E. The other end portion of the shaft 43 defines another serration portion 43*d* located adjacent or next to the intermediate portion 43*b*.

A brake gear 44 is mounted on the serration portion 43*c* of the shaft 43 and is thus rotated together with the serration portion 43*c*. A driven gear 45 is positioned in the accommodating space E. The driven gear 45 is fixedly mounted on a pin 45*a* whose opposite end portions are journalled in the housing 81 and the cover 84 respectively. The driven gear 45 is positioned in opposition to the brake gear 44. The brake gear 45 is in indirect meshing engagement with the driven gear 44 via the geared cable 6 which extends through the accommodating space E.

An armature 46 is mounted on the serration portion 43*d* of the shaft 43 so that the armature is movable along the serration portion 43*d* of the shaft 43 and is rotatable together with the serration portion 43*d* of the shaft 43. The armature 46 is formed of a magnetic material and is configured as a circular plate.

The armature 46 is urged continually by a spring 47 that is arranged around the shaft 43 so that the armature 46 is in slight face-to-face contact with the friction plate 40.

In the foregoing structure, if the coil winding 38 of the coil winding device 35 is energized, a magnetic closed loop is formed which passes through the coil winding 38, the core 36, and the armature 46, thereby generating an electromagnetic force which attracts the armature toward the rotor 36. Thus, the armature 46 moves along the shaft 43 toward the rotor 36, with the result that the armature 46 is strongly brought into engagement with the friction plate 40. This thus results in a large friction force being applied as a brake force to the armature 46 under rotation.

On the other hand, if the coil winding 38 of the coil winding device 35 is de-energized, there is no magnetic attraction force attracting the armature toward the rotor 36 and so the armature 46 is able to rotate freely relative to the friction plate 40. The reason is that between the friction plate 40 and the armature 46 under rotation, there is only a very small amount of friction force braking the friction plate 40.

The operation of the brake device 99 in conjunction with the movement of the slide door 1 is as follows. While the slide door 1 is moving, the geared cable 6 is also moving in one direction (or the other direction), and the meshing engagement between the geared cable 6 and the brake gear 44 causes the brake gear 44, the shaft 43, and the armature 46 to rotate.

When the slide door 1 is moving by virtue of either the driving operation of the driving device 8, manual operation, or gravity unexpectedly applied to the slide door 1 when the vehicle is parked on a slanted or sloping road, the CPU calculates the sliding speed of the slide door 1 on the basis of the signals issued from the sensor 32. If the detected sliding speed of the slide door 1 exceeds a predetermined value, the coil winding 38 of the coil winding device 35 is energized, and an immediate and strong engagement of the armature 46 with the friction plate 40 occurs, thereby generating a very large friction force between the armature 46 and the friction plate 40. Thus, with little time lag, a braking force is applied to the slide door 1.

The foregoing operation of the brake device 99 is under the control of the CPU. The control allows the operator to move the slide door 1 in a smooth manner when the slide door 1 is moved in the manual mode.

In addition, in the case where no driving device 8 is provided to the vehicle, the brake device 99 can be applied thereto. That is, solely the brake device 99 can be employed. In this structure, the magnet 31 is positioned on the armature 46 and the sensor 32 opposing thereto detects the rotational condition of the armature 46 for determining the sliding speed, the sliding direction, and the current position of the slide door 1.

In accordance with the present invention, the first rotation disc assembly and the second rotation disc assembly are advantageously mounted on a common shaft to thereby establish a thinner driving device.

The principles, preferred embodiment and modes of operation of the present invention have been described in the foregoing specification. However, the invention which is intended to be protected is not to be construed as limited to the particular embodiment described. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. A drive device for a vehicle slide door apparatus comprising:

a shaft for transmitting a force derived from an electric driving source to the slide door for effecting sliding movement of the slide door;

a first rotation disc assembly mounted on the shaft for rotating together with the shaft;

a second rotation disc assembly mounted on the shaft and configured and arranged for operative connection to the electric driving source, the second rotation disc assembly being adapted to be coupled to the first rotation disc assembly in a detachable manner, the second rotation disk assembly being rotatable relative to the shaft when the second rotation disk assembly is not coupled to the first rotation disk assembly; and an output member mounted on the shaft to rotate together with the shaft;

wherein the output member is positioned at one end portion of the shaft, the first rotation disc assembly is positioned adjacent an opposite end portion of the shaft, and the second rotation disc assembly is positioned between the output member and the first rotation disc assembly.

2. The drive device as set forth in claim 1, further comprising a casing having an interior, the interior of the casing being divided into a first inner space and a second inner space by a plate.

3. The drive device as set forth in claim 1, further comprising a coil winding device positioned relative to the second rotation disc assembly so that the first rotation disc assembly is positioned between the coil winding device and the second rotation disc assembly.

4. The drive device as set forth in claim 3, wherein the second rotation disc assembly includes an input wheel rotatably mounted on the shaft and operatively associated with a speed reduction gear train, an output wheel rotatably mounted on the shaft and associated with the input wheel via an elastic member, and an armature mounted to the output wheel to be coupled with the first disc assembly in a detachable manner and opposed to the coil winding device.

5. The drive device as set forth in claim 4, wherein the shaft is journalled in a casing in which are accommodated the first rotation disc assembly, the second rotation disc assembly, the coil winding device, and the speed reduction gear train.

6. A drive device as set forth in claim 5, wherein the coil winding device is coupled to the casing via an anti-vibration member.

7. A drive device as set forth in claim 5, wherein an interior of the casing is divided into a first inner space and a second inner space by a plate, the input wheel and the speed reduction gear train being accommodated in the first inner space, and the output wheel, the movable plate, the first rotation disc assembly, and the coil winding device being accommodated in the second space.

8. A drive device for a vehicle slide door comprising:

an electric drive source for producing an output force;

a rotatable shaft for transmitting a force derived from the electric driving source to the slide door for effecting sliding movement of the slide door;

an output gear mounted on the shaft for rotation together with the shaft;

a cable connectable to the slide door and engaged by the output gear;

a clutch mechanism mounted on the shaft for transferring the force derived from the electric driving source to the shaft to rotate the shaft, the clutch mechanism including a first rotation disc assembly mounted on the shaft for rotating together with the shaft and a second rotation disc assembly mounted on the shaft, said second rotation disc assembly being operatively connected to the electric driving source and said clutch mechanism being operable to cause engagement between the first rotation disc assembly and the second rotation disc assembly to thereby operatively connect the electric driving source to the shaft to rotate the shaft and thereby cause rotation of the output gear and movement of the cable for effecting sliding movement of the slide door, the second rotation disk assembly being rotatable relative to the shaft when the second rotation disk assembly is not engaged with the first rotation disk assembly;

wherein the output gear is positioned at one end portion of the shaft, the first rotation disc assembly is positioned adjacent an opposite end portion of the shaft, and the second rotation disc assembly is positioned between the output gear and the first rotation disc assembly.

9. The drive device as set forth in claim 8, wherein a coil winding device is positioned in opposition to the second rotation disc assembly so that the first rotation disc assembly is positioned between the coil winding device and the second rotation disc assembly.

10. The drive device as set forth in claim 9, wherein the second rotation disc assembly includes an input wheel rotatably mounted on the shaft and operatively associated with a speed reduction gear train, an output wheel rotatably mounted on the shaft and associated with the input wheel via an elastic member, and an armature mounted on the output wheel to be coupled with the first disc assembly in a detachable manner and opposed to the coil winding device.

11. The drive device as set forth in claim 10, wherein the shaft is journalled in a casing in which are accommodated the first rotation disc assembly, the second rotation disc assembly, the coil winding device, and the speed reduction gear train.

12. The drive device as set forth in claim 11, wherein the coil winding device is coupled to the casing via an anti-vibration member.

13. A vehicle slide door apparatus comprising:

a slide door mounted on a lateral side of a vehicle body for movement in a lengthwise direction of the vehicle body between an open position and a closed position;

a connecting member connected to the slide door to move with the slide door;

an electric drive source;

a rotatable shaft journalled in a casing;

an output gear mounted on the shaft for rotation together with the shaft, said connecting member being engaged by the output gear so that said output gear and said connecting member move together; and a clutch mechanism mounted on the shaft for transferring the force derived from the electric driving source to the shaft to rotate the shaft, the clutch mechanism including a first rotation disc assembly mounted on the shaft for rotating together with the shaft and a second rotation disc assembly mounted on the shaft, said second rotation disc assembly being operatively connected to the electric driving source and said clutch mechanism being operable to cause engagement between the first rotation disc assembly and the second rotation disc assembly to thereby operatively connect the electric driving source to the shaft to rotate the shaft and thereby cause rotation of the output gear and movement of the connecting member for effecting sliding movement of the slide door, the second rotation disk assembly being rotatable relative to the shaft when the second rotation disk assembly is not engaged with the first rotation disk assembly;

wherein the output gear is positioned at one end portion of the shaft, the first rotation disc assembly is positioned adjacent an opposite end portion of the shaft, and the second rotation disc assembly is positioned between the output gear and the first rotation disc assembly.

14. The vehicle slide door apparatus as set forth in claim 13, including a coil winding device positioned in opposition to the second rotation disc assembly so that the first rotation disc assembly is positioned between the coil winding device and the second rotation disc assembly.

15. The vehicle slide door apparatus as set forth in claim 14, wherein the coil winding device is coupled to the casing via an anti-vibration member.

16. The vehicle slide door apparatus as set forth in claim 15, wherein the first rotation disc assembly, the second rotation disc assembly, the coil winding device, and the speed reduction gear train are accommodated in the casing.

17. The vehicle slide door apparatus as set forth in claim 14, wherein the second rotation disc assembly includes an input wheel rotatably mounted on the shaft and operatively associated with a speed reduction gear train, an output wheel rotatably mounted on the shaft and associated with the input wheel via an elastic member, and an armature mounted on the output wheel to be coupled with the first disc assembly in a detachable manner and opposed to the coil winding device.

* * * * *